US006036393A

United States Patent [19]

Youtcheff et al.

[11] Patent Number: 6,036,393

[45] **Date of Patent: *Mar. 14, 2000**

[54] SOAP SAVER AND DISPENSER NOVELTY

[76] Inventors: John S. Youtcheff, 1400 S. Joyce St., Arlington, Va. 22202; George V. Buonocore, 5788 Flagflower Pl., Columbia, Md. 21045

[ * ] Notice: Under 35 U.S.C. 154(b), the term of this patent shall be extended for 93 days.

[21] Appl. No.: 08/620,658

[22] Filed: Mar. 22, 1996

[51] Int. Cl.[7] ..... A47K 5/04; A47K 5/14

[52] U.S. Cl. ..... 401/201; 401/207

[58] Field of Search ..... 401/201, 207, 401/196; 446/8; D32/43

[56] References Cited

U.S. PATENT DOCUMENTS

| | | | |
|---|---|---|---|
| 14,710 | 8/1856 | Hobbs . | |
| 1,511,969 | 10/1924 | Hoy | 401/196 |
| 1,801,915 | 4/1931 | Gray | 401/207 X |
| 1,909,966 | 5/1933 | Jones | 401/201 |
| 2,070,313 | 2/1937 | Pieper | 401/201 |
| 2,779,128 | 1/1957 | West | 446/8 |
| 3,099,032 | 7/1963 | Webb | 401/201 X |
| 3,114,928 | 12/1963 | Spiteri | 401/201 |
| 3,143,755 | 8/1964 | Rowley . | |
| 3,426,464 | 2/1969 | Mezey | 401/201 |
| 4,078,865 | 3/1978 | Moser | 401/207 X |

FOREIGN PATENT DOCUMENTS

| | | | |
|---|---|---|---|
| 1128833 | 1/1957 | France | 401/201 |
| 1128876 | 1/1957 | France | 401/201 |
| 3530402 | 6/1986 | Germany | 401/207 |

*Primary Examiner*—Steven A. Bratlie
*Attorney, Agent, or Firm*—Laurence R. Brown

[57] ABSTRACT

A multipurpose two piece soap dispenser is provided with an ornamental water impervious hollow reservoir body portion with a coin-type slot therethrough for inserting and retaining soap chips. The reservoir body portion has a lowermost opening covered by a water absorbent body, typically a synthetic sponge. Thus, the primary function is for lathering and scrubbing the body either at a sink, wash basin or in a bathtub or shower. A secondary function is the thrift and savings to be realized with the reservoir body constituting a piggy bank for retaining soap chips coming from almost spent soap bars fed into the slot. A third function is that the soap dispenser may be in the ornamental format of a toy, sports item or other novelty. The construction provides advantages as a readily manufactured item formed from two basic pieces secured together. The pieces are secured either adhesively or mechanically so that a simple sponge or equivalent and a rubbery resilient hand held pig, puppy or the like makes an attractive toy, which can be fueled with usually wasted soap chips.

1 Claim, 2 Drawing Sheets

SOAP SAVER AND DISPENSER NOVELTY

TECHNICAL FIELD

This invention relates to toiletry accessories, and more particularly it relates to a hand held soap saver and dispenser for use in bath, shower or sink, that also functions as a novelty ornamental toiletry accessory.

BACKGROUND ART

Bathing aid toys have been proposed such as a sponge whale with an interior bladder that spouts soapy water out a blow hole, as set forth in Rowley U.S. Pat. No. 3,143,755, Aug. 11, 1964. This toy is most difficult to fabricate because of its shape and the requirement to integrate an inner bladder with a squeeze actuated water spout into the sponge as well as an external entry slit for inserting a cake of soap. Furthermore it is dangerous in operation, since it may be used to squirt soapy water that is most damaging to the eye. Also it encourages untidy bathrooms with water splashed everywhere. The utility of this toy as a toiletry accessory is minimal, since the squirting of soapy water does not substantially serve to clean and scrub the hands or body. Also it inefficiently uses and therefore wastes soap by directing it to other functions than lathering of the body. Thus, this is neither an acceptable toy, nor toiletry accessory.

It has been heretofore proposed that sponges have buried therein a cake or used chips of soap to serve as a toiletry accessory for lathering and scrubbing the hands at a sink or the body in a bathtub. Typical is the Hobbs U.S. Pat. No. 14,710, Aug. 19, 1919 wherein a metal clamshell serves as a receptacle for soap chips internally and carries sewed on sponges externally for lathering and scrubbing the body. Again such accessories are intricate and difficult to manufacture and may be dangerous in the presence of children. The clamshell mechanism, for example, constitutes a sharp instrument that may cut or bruise a user. Mechanisms such as the hinged clamshell assembly usually rust or deteriorate in the presence of water or a damp environment and thus are hard to keep sanitary. Furthermore such accessories are hard to store and is not ornamentally acceptable either as a toy or a toilet accessory.

Thus, it is an objective of this invention to provide improved toiletry accessories for lathering the human body that are ornamental and suitable for use by children or adults without danger or untidiness.

DISCLOSURE OF THE INVENTION

The toilet dispenser of this invention comprises a multipurpose soap lather dispenser constituting only two parts. One of the parts comprises a water impervious hollow reservoir body that may be either squeezable resilient or stiff, typically an elastomeric, a rigid plastic or a ceramic. This reservoir body is adapted by an uppermost coin-type slot to receive soap chips such as those from the last remnants of a soap bar. A lowermost opening is adapted to be covered by a water absorbent body, typically a synthetic sponge, which stores and generates soapy lather from internally disposed soap chips.

The primary function of the soap saving dispenser is for generating a lather for scrubbing the body either at a sink, shower, wash basin, or in a bathtub. A secondary function is the thrift and savings of soap chips/particles of used residue soap often washed down the drain because they are too small or slippery to use. A third function is that the soap dispenser is an ornamental novelty accessory that may be in the format of a favorite toy, animal, sports object or sculpture.

The construction of this soap dispenser is such that it is readily manufactured from two basic pieces simply secured together in some manner such as mechanically or adhesively. Thus a simple synthetic sponge or equivalent and a rubbery resilient pig or puppy shaped reservoir makes an attractive and useful toiletry accessory, which can be fueled with usually wasted soap chips. This accessory can be grasped in one hand to lather and scrub the hands or body and is safely and neatly used as a child's toy in the bathtub.

Other objects, features and advantages of the invention will be found throughout the following description, appended drawings and accompanying claims.

BRIEF DESCRIPTION OF THE DRAWINGS

In the following drawings, like reference characters refer to similar features throughout the respective views to facilitate comparison, wherein.

THE PREFERRED EMBODIMENTS

Figure 1:
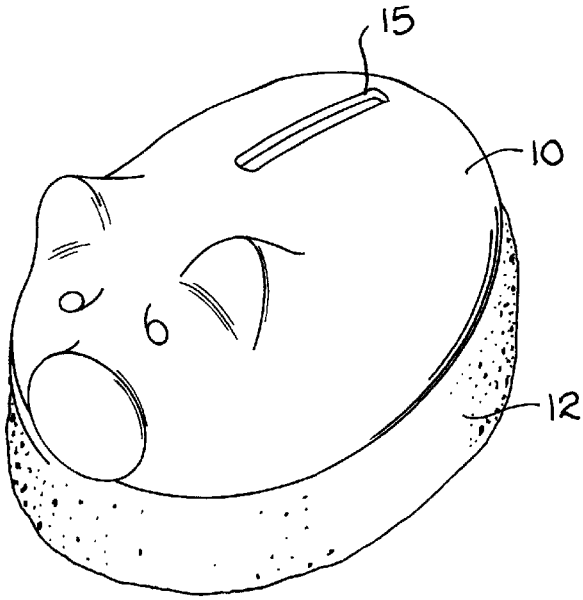
FIG. 1 is a perspective view of the lather dispensing toilet accessory afforded by the invention.
Figure 2:
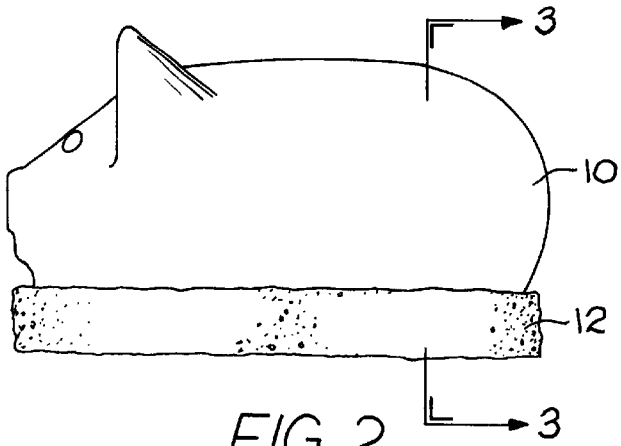
FIG. 2 is a side view of the lather dispenser embodiment of FIG. 1.

A s seen from FIGS. 1 and 2 the ornamental soap lather dispenser is shaped as an animal or some other ornamental figure, in this embodiment being a pig. The two piece construction includes a first substantially water impervious hollow body portion 10 serving as an upper portion of a piggy bank configuration. The uppermost coin-type slot 15 through the hollow body portion 10 is adapted to receive soap chips, such as the residue portions of spent bars of soap. This ornamental figure is preferably of a resilient material, such as a polyurethane elastomer, for use in a bathtub as a child's toy. However a rigid material such as ceramic or rigid plastic may be desirable as an ornamental toiletry accessory to be lodged in a soap tray at a wash basin for use in lathering and scrubbing the hands.

This upper body portion 10 thus comprises a reservoir for accumulating a supply of soap chips when its lowermost opening 11 is covered by a water absorbent body such as a synthetic sponge 12. This second water absorbent body portion 12 is securely attached to the first body to cover said lowermost opening and form a closed reservoir for retaining the soap chips as a piggy bank retains coins. By wetting the sponge, a lather may be induced and the dispenser is used as a bath article accessory for lathering and scrubbing the hands and body.

Figure 3:
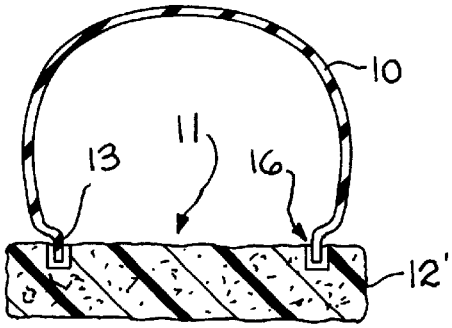
FIG. 3 is a section view of a first embodiment, showing the hollow interior as seen by looking into lines 3—3 of FIG. 2.
Figure 4:
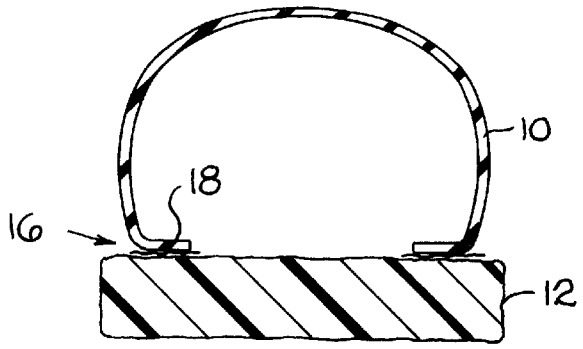
FIG. 4 is a similar section view of a second embodiment.

The water absorbing and lather dispensing sponge body portion 12 is secured to the reservoir body portion 10 by appropriate adhesive or mechanical structure, thereby to cover the lowermost opening 11 in the reservoir body 10. Thus adhesive structure 16 holds the sponge body portion 12 in place to cover the opening 11 in the reservoir body portion 10, as shown in FIGS. 3 and 4. Alternatively the sponge portion 12 may be mechanically secured in some manner such as "Velcro" strips or the reception frame or rack 17 shown in the embodiment of FIGS. 5 and 6. The synthetic sponge body 12' may be indented as shown in FIG. 3 to mate with the projections 13 extending from the receptacle body portion 10, or may be simply a slab 12, 12" as shown in FIGS. 4–6.

As seen in FIG. 4, the adhesive substance 16 is spread upon the horizontal flanges 18 of the upper reservoir body 10 to be mated with the flat sponge surface. The adhesive substance 16 could for example be a well known adhesive for removably adhering the two body portions 10, 12 such as is commercially available under the "Velcro" brand. It is thus seen that this invention provides a simplified two piece construction for a lathering and scrubbing soap dispenser toilet accessory.

Figure 5:
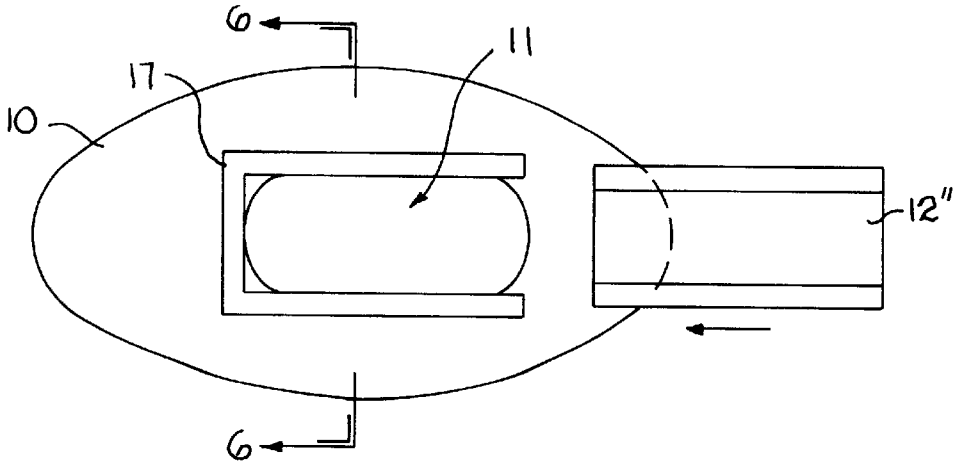
FIG. 5 is a bottom view of a further embodiment of the invention.
Figure 6:
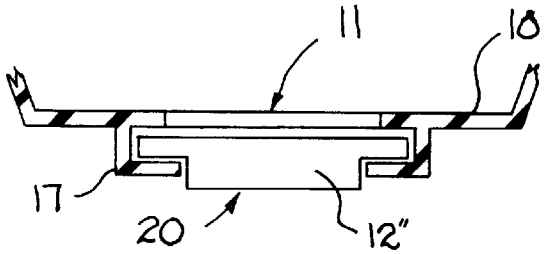
FIG. 6 is a section view looking into lines 6—6 of the FIG. 5 embodiment.

In the embodiment of FIGS. 5 and 6, it is seen that a mechanical rack or framework 17 is secured to the upper reservoir body 12, such as an integral extension upon a ceramic or rigid plastic upper body 10. This rack 17 is sized such to permit a compressed and dehydrated synthetic sponge body 12" to slide snugly into place. Thus when the sponge 12" is wetted it expands and clamps itself in place for use in closing the opening 11 and dispensing lather. By means of this structure the sponge is removably retained thereby permitting it to be replaced as an expendable item when worn or soiled.

This invention therefore provides a bath article accessory in the form of a decorative scrub brush or water toy particularly desirable for children. This accessory has a decorative water impervious body portion of a size and construction to be grasped securely in one hand when wet. To this water impervious body portion, either permanently or removably is affixed to a washing implement, namely a water and lather dispensing absorbent sponge-like body adapted to absorb, dispense and scrub soap lather on the human body.

It is therefore recognized that this invention has advanced the state of the art and thus those features of novelty descriptive of the nature and spirit of the invention are set forth with particularity in the following claims.

We claim:

1. An ornamental hand carried soap dispenser comprising in combination a hollow ornamental reservoir body portion of substantially water impervious material having a lowermost opening, a water absorbent body portion with an exterior scrubbing surface configured to close said lowermost opening thereby exposing the scrubbing surface for use, securing means for retaining the water absorbent body portion to the ornamental body portion in a position covering said lowermost opening of said ornamental body portion thereby to generate soapy lather from internally disposed soap chips and to present an exterior scrubbing surface, and means comprising an open soap remnant receiving slot passing through the ornamental reservoir body portion for introducing soap chips thereby to generate soapy lather from internally disposed soap remnants for lathering and scrubbing the hands and body where said water absorbent body portion initially comprises a compressed dehydrated synthetic sponge adapted to swell when wetted, and said securing means comprises a sponge holder adapted to receive the compressed sponge and to retain the sponge securely in the sponge holder when the sponge is wetted.

* * * * *